US011135638B2

(12) United States Patent
Huang

(10) Patent No.: US 11,135,638 B2
(45) **Date of Patent: *Oct. 5, 2021**

(54) PIPE ENLARGING DEVICE

(71) Applicant: Yu-Shiang Huang, Taichung (TW)

(72) Inventor: Yu-Shiang Huang, Taichung (TW)

( * ) Notice: Subject to any disclaimer, the term of this patent is extended or adjusted under 35 U.S.C. 154(b) by 153 days.

This patent is subject to a terminal disclaimer.

(21) Appl. No.: 16/520,361

(22) Filed: Jul. 24, 2019

(65) Prior Publication Data

US 2020/0338622 A1 Oct. 29, 2020

Related U.S. Application Data

(63) Continuation-in-part of application No. 16/396,791, filed on Apr. 29, 2019, now Pat. No. 11,072,019.

(51) Int. Cl.
*B21D 41/02* (2006.01)

(52) U.S. Cl.
CPC ..... *B21D 41/026* (2013.01)

(58) Field of Classification Search
CPC ..... B25B 5/147; B25B 5/00; B25B 5/067; B25B 5/101; B25B 5/14; B25B 1/2415; B25B 1/2421; B25B 1/2489; B25B 1/2442; B25B 1/2436; B25B 3/00; B21D 39/08; B21D 39/20; B21D 39/12; B21D 41/026; B21D 41/02; B21D 41/021; B21D 41/025; B21D 19/08; B29C 57/02; B29C 57/04
USPC ..... 72/457, 460, 459; 269/108, 109, 110, 269/111, 45, 254; 29/243.55
See application file for complete search history.

(56) References Cited

U.S. PATENT DOCUMENTS 2,277,410 A * 3/1942 Neukirch ..... B21D 41/021 72/125
RE24,051 E * 8/1955 Wolcott ..... B21D 41/021 72/116
2,736,360 A * 2/1956 Quercetti ..... B21D 41/021 72/318
2,892,480 A * 6/1959 Franck ..... B21D 41/021 72/317
3,103,245 A * 9/1963 Iskyan ..... B21D 41/021 72/317
4,174,646 A * 11/1979 Kotler ..... B25B 23/16 30/101

FOREIGN PATENT DOCUMENTS

ES 1574269 A1 * 9/2005 ..... B21D 41/02

* cited by examiner

*Primary Examiner* — Adam J Eiseman
*Assistant Examiner* — Claudia V Caldera

(57) ABSTRACT

A pipe enlarging device includes a base, an operation unit and a clamping unit. The clamping unit is received in the base, and includes movable front and rear clamps and a front threaded rod. The front and rear clamps are resiliently movable when the front threaded rod is rotated so as to form an adjustable clamping area between the front and rear clamps. The clamping area is used to clamp pipes of different sizes. The operation unit includes a top threaded rod with a cone-shaped member which is used to enlarge the inner diameter of the pipes.

4 Claims, 13 Drawing Sheets

PIPE ENLARGING DEVICE

The present invention is a Continuation-In-Part application of applicant's former patent application with the application Ser. No. 16/396,791, filed on Apr. 29, 2019.

BACKGROUND OF THE INVENTION

1. Fields of the Invention

2. Descriptions of Related Art

The conventional pipe enlarging device is disclosed in FIGS. 14 and 15, and includes a base 91, a top threaded rod 92, a front threaded rod 93 and a positioning member 94. The base 91 includes a passage 911 defined therethrough, and the top threaded rod 92 and the front threaded rod 93 respectively and threadedly extend into the base 91. The top threaded rod 92 and the front threaded rod 93 are perpendicular to each other. The top threaded rod 92 includes a cone-shaped member. The positioning member 94 movably extends through the passage 911 and includes multiple holes 941 of different sizes so as to accommodate pipes 95 of different sizes. When in use, the front threaded rod 93 contacts against one side of the positioning member 94 and the cone-shaped member is inserted into the pipe 95 that extends through one of the holes 941. The pipe 95 is enlarged by the cone-shaped member when rotating the top threaded rod 92.

However, the positioning member 94 has to be long enough to include the multiple holes 941, and the long positioning member 94 includes cost. The users have to align the central axis of the hole 941 with the center tip of the cone-shaped member. Once the central axis of the hole 941 is not aligned with the center tip of the cone-shaped member, the front threaded rod 93 has to be unscrewed to adjust the positioning member 94. The cone-shaped member is located within the passage 911 and is not convenient for the users to adjust the position of the hole 941 relative to the cone-shaped member.

The present invention intends to provide a pipe enlarging device that includes movable front, rear, left and right clamps to form an adjustable clamping area so as to clamp pipes of different sizes.

SUMMARY OF THE INVENTION

The present invention relates to a pipe enlarging device and comprises a base, an operation unit and a clamping unit. The clamping unit is received in the base and includes movable front and rear clamps, multiple resilient members and a front threaded rod. The front and rear clamps are resiliently movable when the front threaded rod is rotated so as to form an adjustable clamping area between the front and rear clamps. The clamping area is used to clamp pipes of different sizes. The operation unit includes a top threaded rod with a cone-shaped member which is used to enlarge the inner diameter of the pipes.

The present invention will become more apparent from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
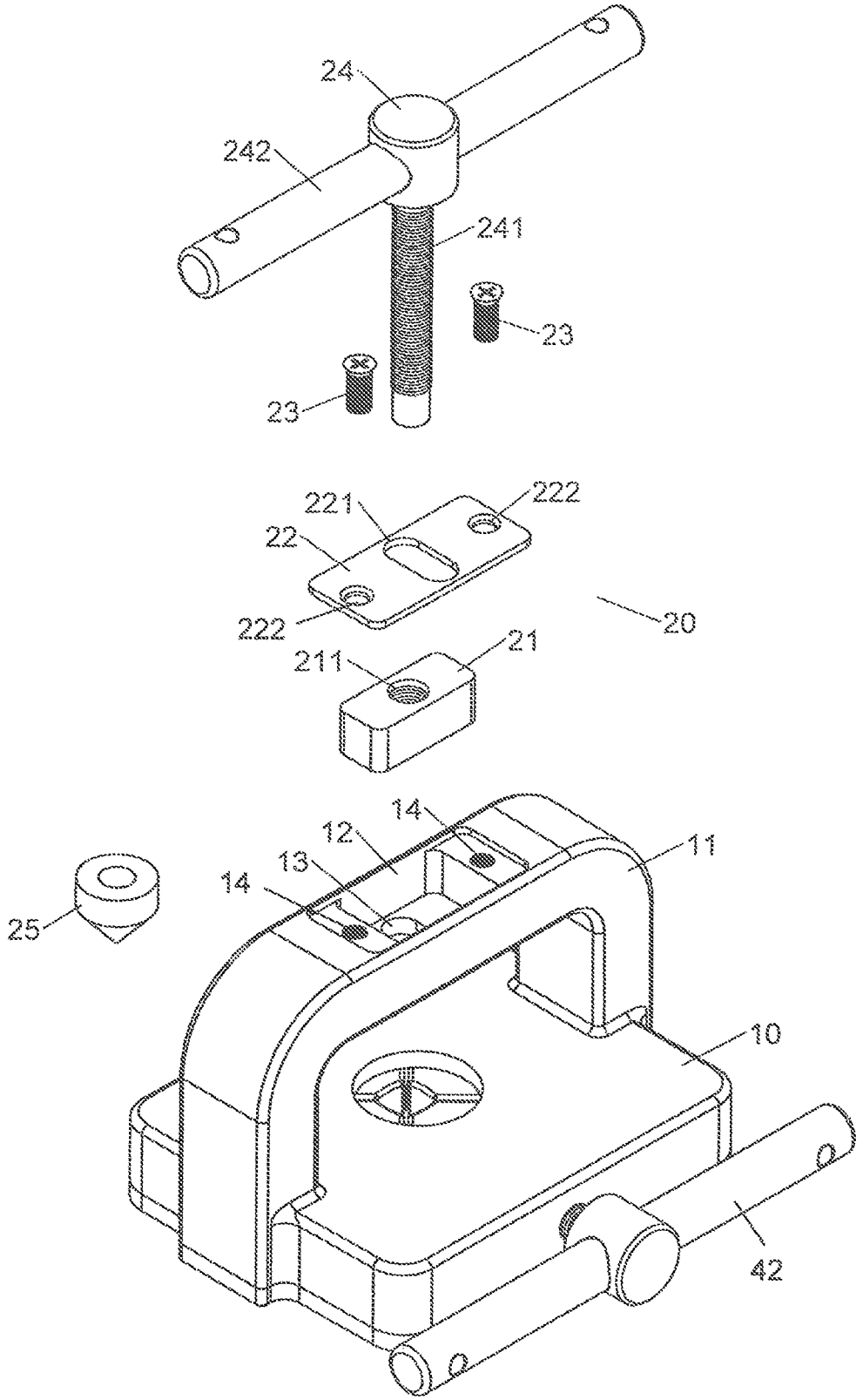
FIG. 1 is an exploded view of the pipe enlarging device of the present invention.
Figure 2:
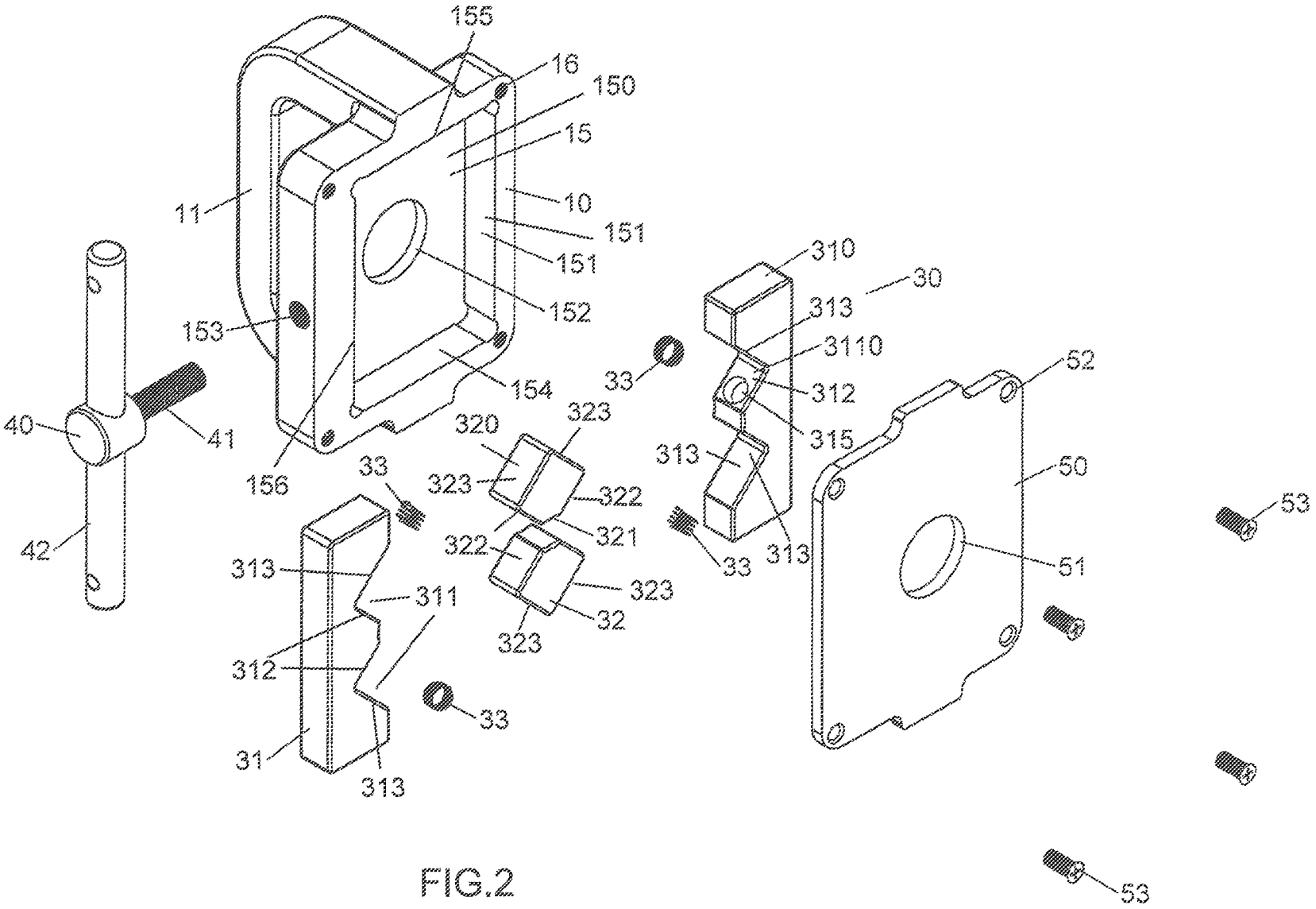
FIG. 2 is another exploded view of the pipe enlarging device of the present invention.
Figure 3:
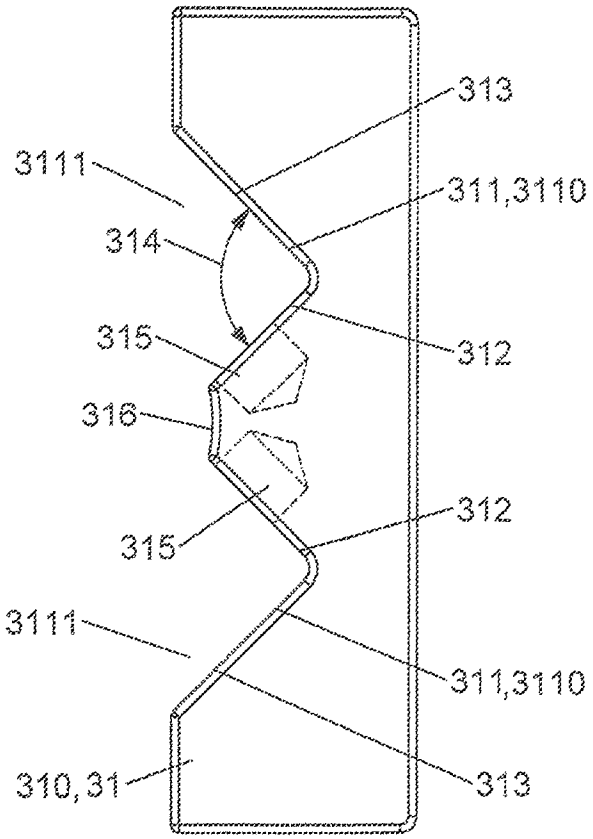
FIG. 3 shows the front clamp of the pipe enlarging device of the present invention.
Figure 4:
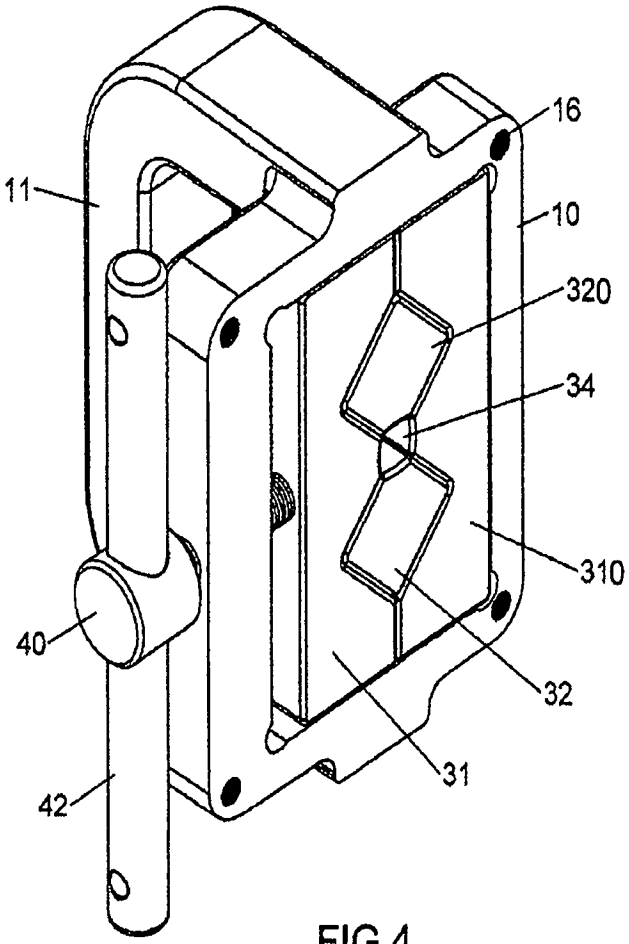
FIG. 4 shows the clamping unit in the room of the base of the pipe enlarging device of the present invention.
Figure 5:
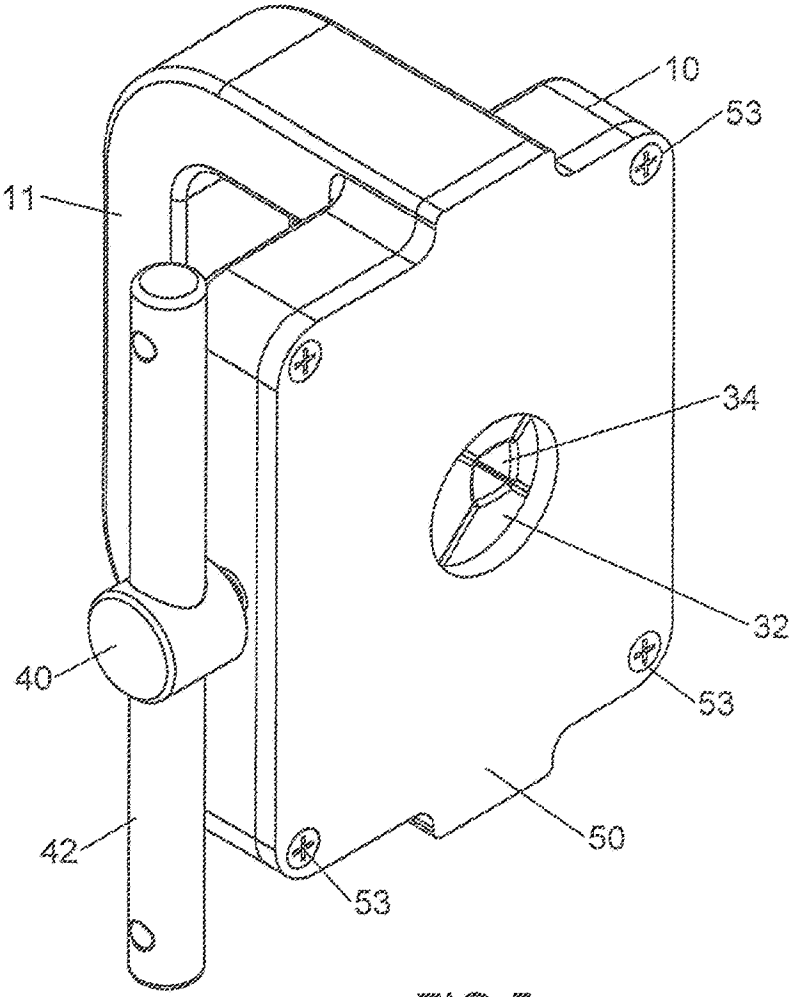
FIG. 5 shows that the plate is connected to the underside of the base of the pipe enlarging device of the present invention.
Figure 6:
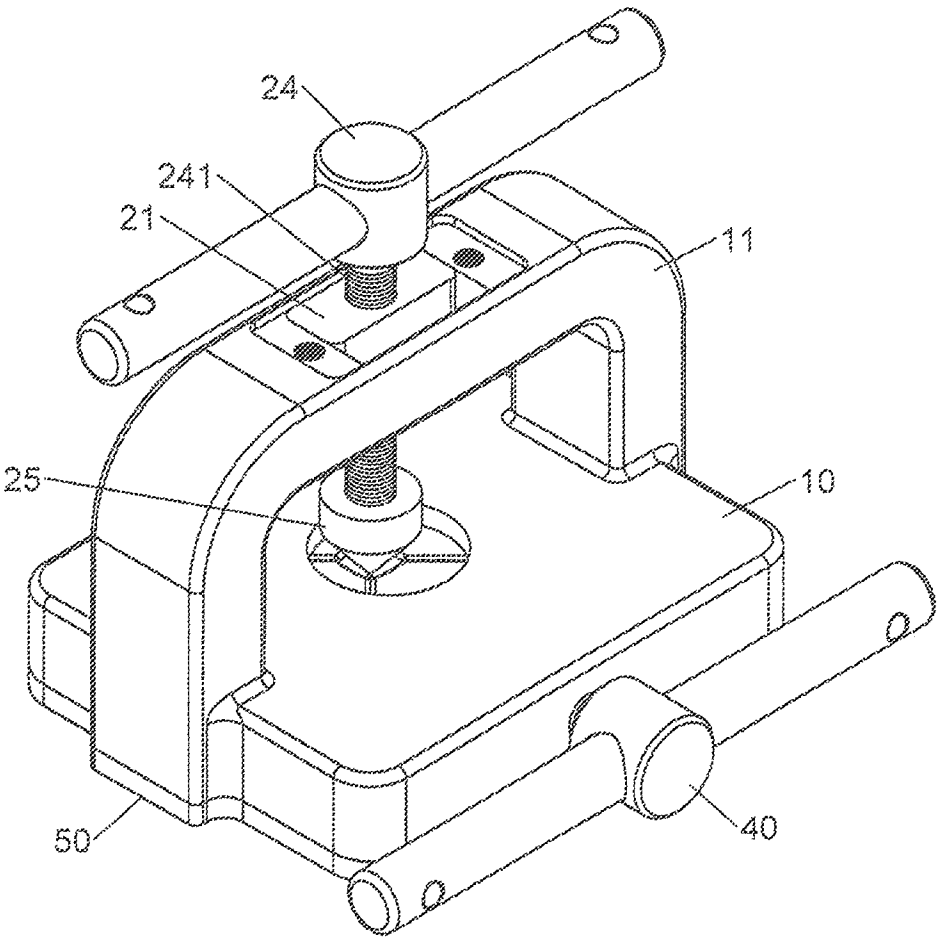
FIG. 6 is a perspective view to show the pipe enlarging device of the present invention, wherein the cover has not yet connected to seal the recess of the bridge.
Figure 7:
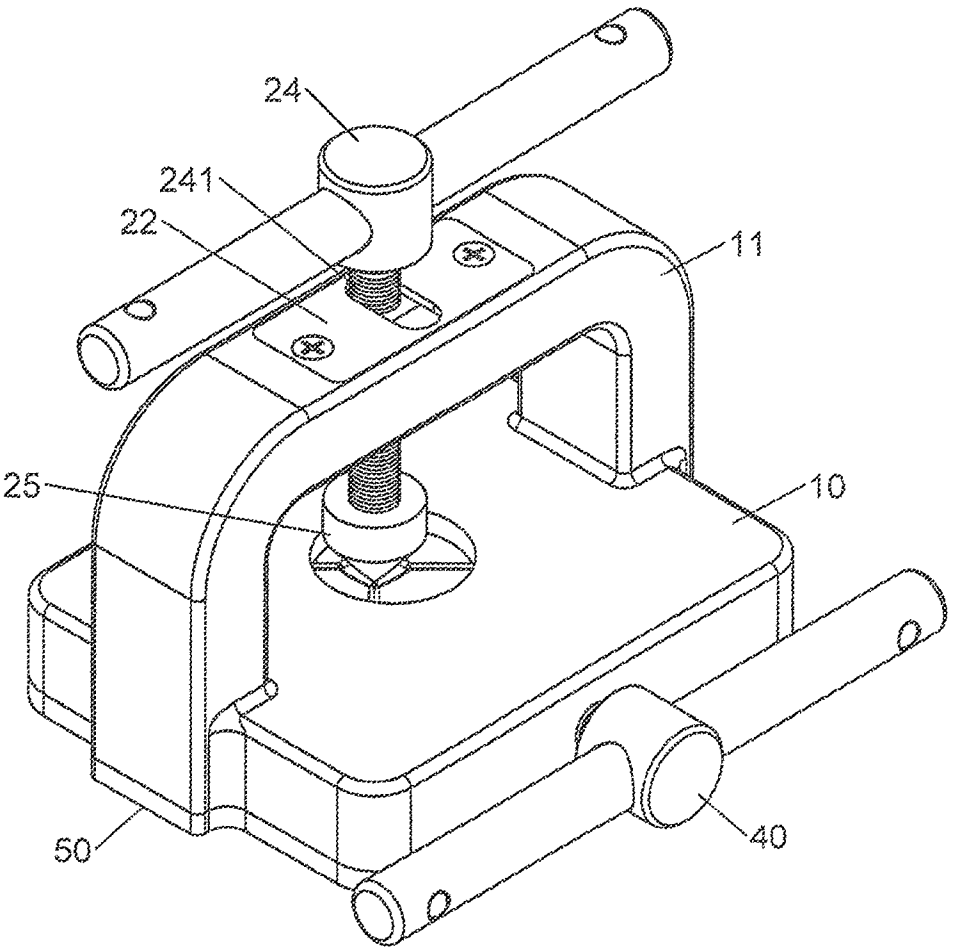
FIG. 7 is a perspective view to show the pipe enlarging device of the present invention, wherein the cover is connected to seal the recess of the bridge.
Figure 9:
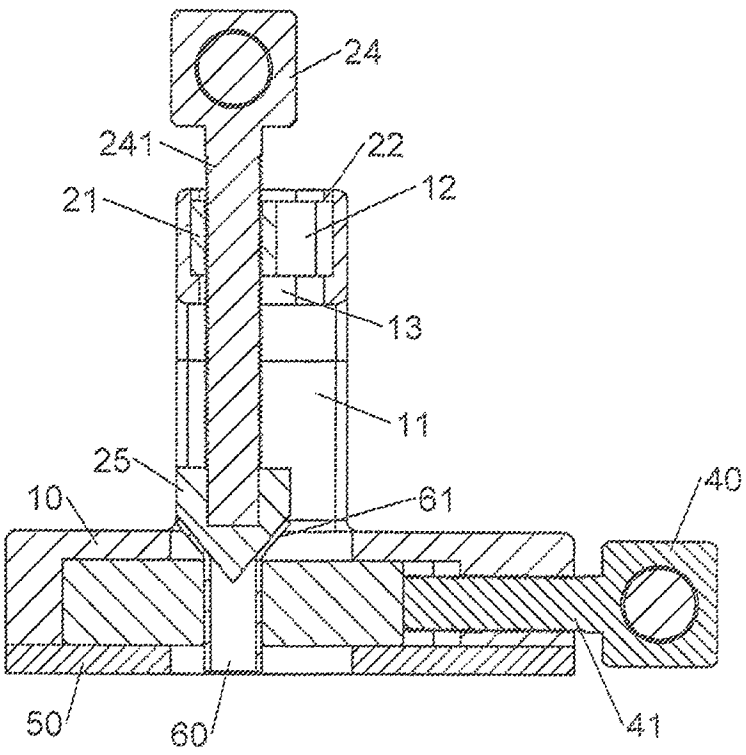
FIG. 9 is a cross sectional view, taken along line A-A in FIG. 8.
Figure 8:
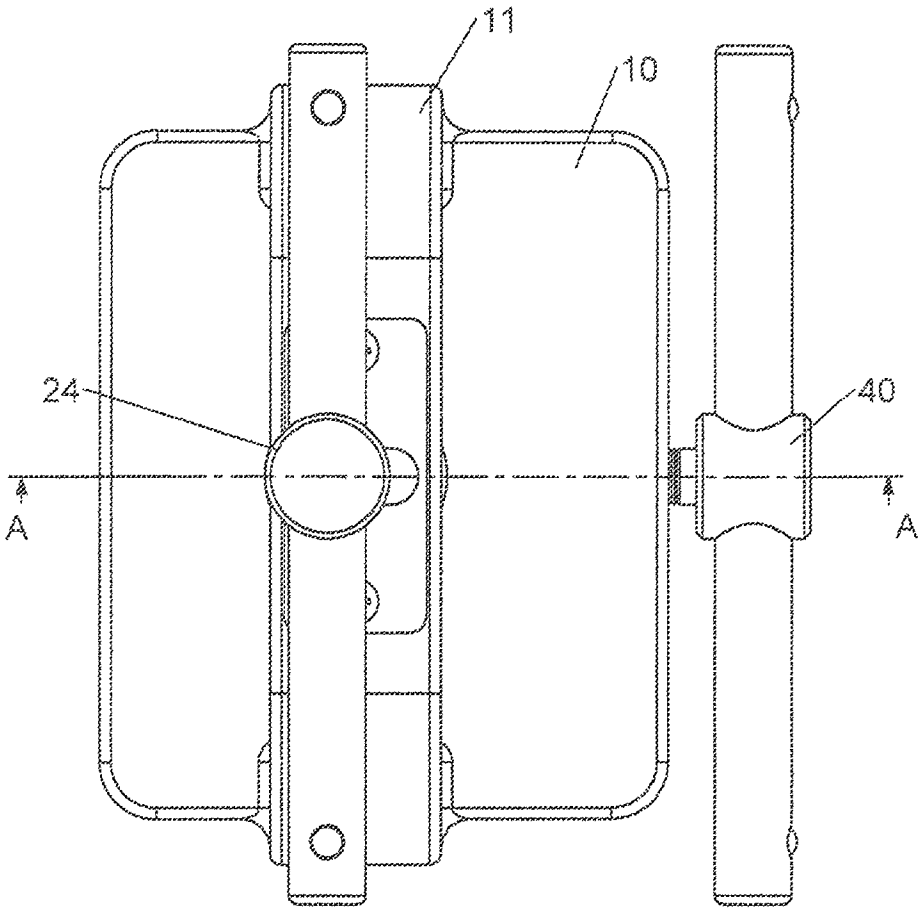
FIG. 8 shows a top view when a first pipe is clamped by the clamping unit of the pipe enlarging device of the present invention
Figure 11:
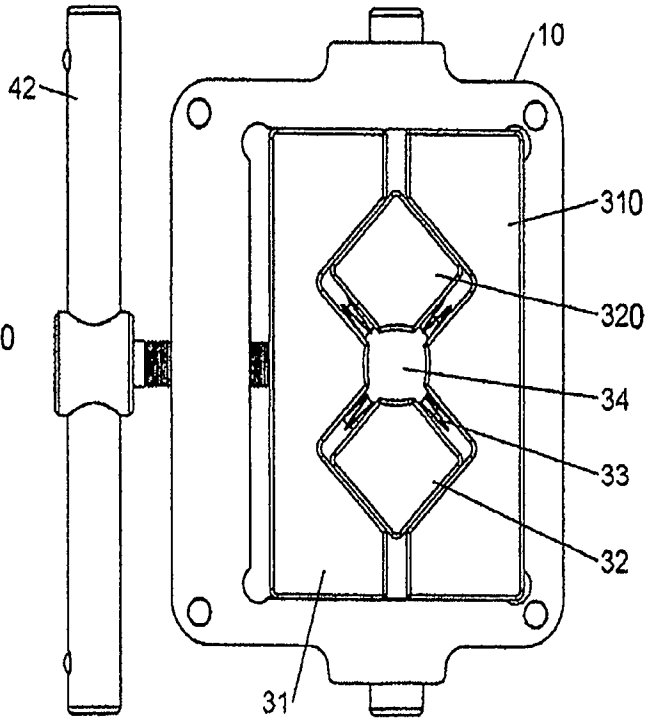
FIG. 11 is a bottom view to show the clamping area formed between the clamps the pipe enlarging device of the present invention.
Figure 10:
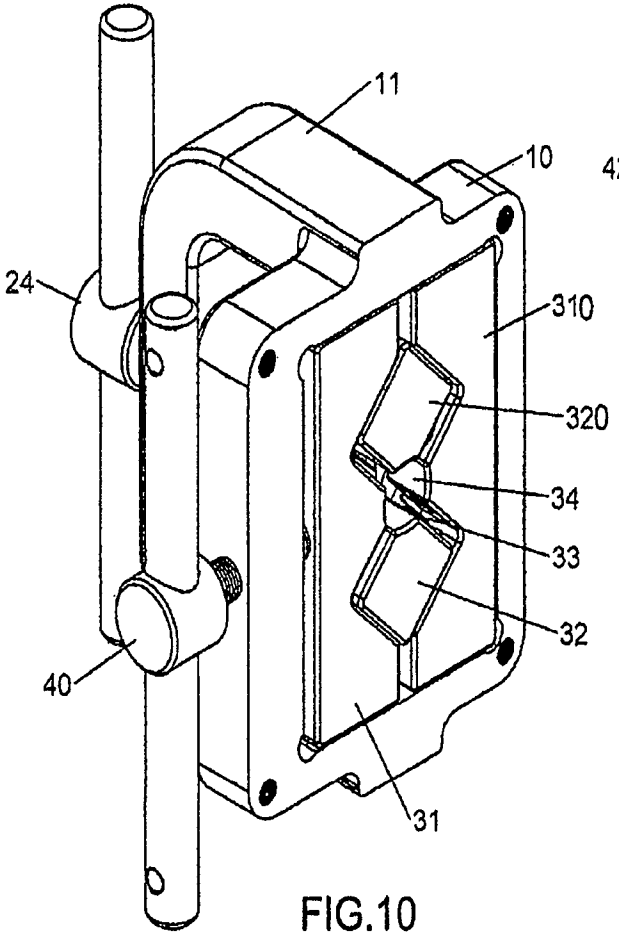
FIG. 10 shows the clamping area is formed between the clamps the pipe enlarging device of the present invention.

Referring to FIGS. 1 to 11, the pipe enlarging device of the present invention comprises a base 10 having multiple locking holes 16 defined in the underside thereof, and a rectangular room 15 is defined in the underside of the base 10 and includes an inner bottom 150, a left wall 154, a right wall 155, a front wall 156 and a rear wall 151. A through hole 152 is defined through the inner bottom 150 and the top of the base 10. A front threaded hole 153 is defined through the front wall 156 and communicates with the rectangular room 15.

A clamping unit 30 is located within the rectangular room 15 and includes a left clamp 32, a right clamp 320, a front clamp 31 and a rear clamp 310 respectively located corresponding to the left wall 154, the right wall 155, the front wall 156 and the rear wall 151. The rear clamp 310 includes one side that is substantially the same length as that of the rear wall 151 so as to be in contact with the rear wall 151. The front clamp 31 includes one side that is substantially the same length as that of the front wall 156 so as to be in contact with the front wall 156. The front clamp 31 includes a left side and a right side, wherein the left and right sides of the front clamp 31 respectively and horizontally slidable along the left wall 154 and the right wall 155. The front clamp 31 includes two first notches 311 defined in the rear side thereof, and the rear clamp 310 includes two second notches 3110 defined in the front side thereof. The rear side of the front clamp 31 faces the front side of the rear clamp 310. Each of the first and second notches 311, 3110 has a guide face 313 and a positioning face 312. A reception area 3111 is defined between the first and second notches 311, 3110. The left clamp 32 and the right clamp 320 are accommodated in the reception area 3111. A first curved face 316 is formed between the two first notches 311, and another first curved face 316 is formed between the two second notches 3110. Each of the left clamp 32 and the right clamp 320 is a substantially square block and has two push faces 322 and two inclined faces 323. A substantially right-angle corner is formed between the two inclined faces 323 of each of the left and right clamps 32, 320. A second curved face 321 is formed between the two push faces 322 of each of the left and right clamps 32, 320. Each of the two inclined faces 323 of each of the left and right clamps 32, 320 is slidable along the guide faces 313 corresponding thereto. Each of the positioning faces 312 includes a receiving hole 315 in which one of two ends of the resilient member 33 corresponding thereto is received. The resilient member 33 is biased between the correspondent push face 322 and the inner end of the receiving hole 315 in the positioning face 312. An angle 314 between the positioning face 312 and the guide face 313 is 90 degrees. The angle between the guide face 313 of each first/second notch 311/3110 of the front and rear clamps 31, 310 is 90 degrees. An angle between the two inclined faces 323 of the left and right clamps 32, 320 is 90 degrees.

A front threaded rod 40 includes threads 41 which are threadedly extending through the front threaded hole 153. The first end of the front threaded rod 40 is inserted into the room 15 to contacts the front clamp 31. A front bar 42 is connected to the second end of the front threaded rod 40 so as to rotate the front threaded rod 40.

When the front and rear clamps 31, 310 are located at a first position, the two respective first curved faces 316 of the front and rear clamps 31, 310 and the two respective second curved faces 321 of the left and right clamps 32, 320 form a clamping area 34 so as to clamp a first pipe 60. When the front threaded rod 40 is rotated to push the front clamp 31 toward the rear clamp 310, the guide faces 313 pushes the inclined faces 323 such that the left and right clamps 32, 320 slide toward each other to move the front clamp 31 and the rear clamp 310 to a second position where the clamping area 34 formed by the first and second curved faces 316, 321 is able to clamp a second pipe whose outer diameter is smaller than that of the first pipe 60. It is noted that the first and second curved faces 316, 321 are perfectly matched with the curvature of the first and second pipes.

A plate 50 is mounted to the underside of the base 10 and closes the room to restrict the clamping unit 30 within the room 15 by extending bolts 53 through the holes 52 of the plate 50 and threadedly connected to the locking holes 16. The plate 50 includes a central hole 51, and the first pipe 60 or the second pipe extends through the central hole 51 of the plate 50 and the through hole 152 of the base 10.

An operation unit 20 includes a bridge 11 connected to the base 10 and the bridge 11 extends over the top of the base 10. A threaded bore 211 is defined through the bridge 11 and the top threaded rod 24 includes threads 241 which threadedly extend through the threaded bore 211. A cone-shaped member 25 is connected to the lower end of the top threaded rod 24. Specifically, the bridge 11 includes a rectangular recess 12 defined in the top thereof. A bore 13 is defined through the inner bottom of the rectangular recess 12 and located corresponding to the through hole 152. The bore 13 is an elongate bore. The operation unit 20 further includes a part 21, a cover 22 and a top bar 242. The part 21 is movably received in the rectangular recess 12. The threaded bore 211 is defined through the part 21. The part 21 and the top threaded rod 24 are co-movable. The cover 22 is mounted to the top of the bridge 11 to restrict the part 21 within the rectangular recess 12. Specifically, two threaded holes 14 are defined in the top of the bridge 11, and the bore 13 is located between the two threaded holes 14. The cover 22 includes two apertures 222, and two bolts 23 extend through the two apertures 222 and are threadedly connected to the two threaded holes 14 of the bridge 11 to fix the cover 22 to the bridge 11 and to close the rectangular recess 12. The top bar 242 is connected to the top threaded rod 24 so as to rotate the top threaded rod 24. The cover 22 includes an elongate hole 221 which is located corresponding to the bore 13, so that the top threaded rod 24 movably extends through the elongate hole 221 and the bore 13.

When the top threaded rod 24 is rotated and the cone-shaped member 25 moves toward the base 10, the cone-shaped member 25 enters into the first pipe 60 or the second pipe and enlarges the inner diameter of the first pipe 60 or the second pipe. In this embodiment, the bridge 11 is integral with the base 10.

The front and rear clamps 31, 310, and the left and right clamps 32, 320 are movable by rotating the front threaded rod 40 within the room 15 so as to clamp pipes of different sizes.

When front threaded rod 40 gradually enters into the room 15, the front and rear clamps 31, 310, and the left and right clamps 32, 320 are moved and compress the resilient members 33 to clamp a smaller pipe.

When front threaded rod 40 gradually moves away from the room 15, the front and rear clamps 31, 310, and the left and right clamps 32, 320 are moved and release the resilient members 33 so as to clamp a larger pipe.

The bridge 11 with the top threaded rod 24 and the cone-shaped member is able to move relative to the base to aim the central axis of the pipe to be enlarged.

When the top threaded rod 24 is rotated to guide the cone-shaped member 25 to enter the opening 61 of the first pipe 60, because the bridge 11 is movable relative to the base 10, so that the cone-shaped member 25 can precisely aim the central axis of the opening 61 of the first pipe 60.

Figure 12:
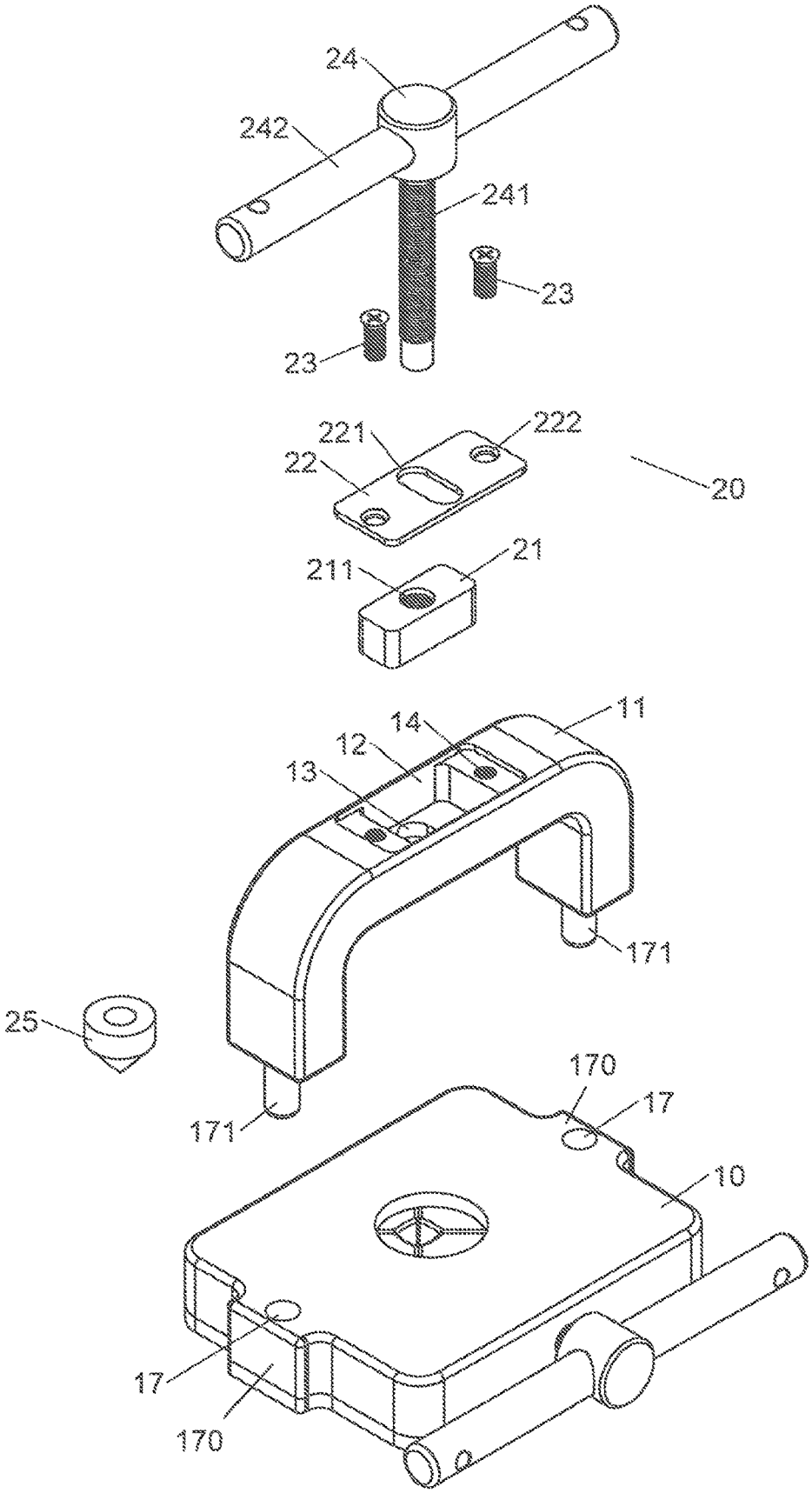
FIG. 12 is an exploded view to show the second embodiment of the pipe enlarging device of the present invention.

As shown in FIG. 12, in this embodiment, the base 10 and the bridge 11 are two individual parts. Two protrusions 170 extend from two sides of the base 10, and two engaging holes 17 are respectively defined in the two protrusions 170 of the base 10. Two engaging columns 171 are respectively defined on the two distal ends of the bridge 11. The two engaging columns 171 are respectively inserted into the corresponding two engaging holes 17, so that the two engaging columns 171 tightly engage with the two engaging holes 17, the bridge 11 fixedly connects to the base 10.

Figure 13:
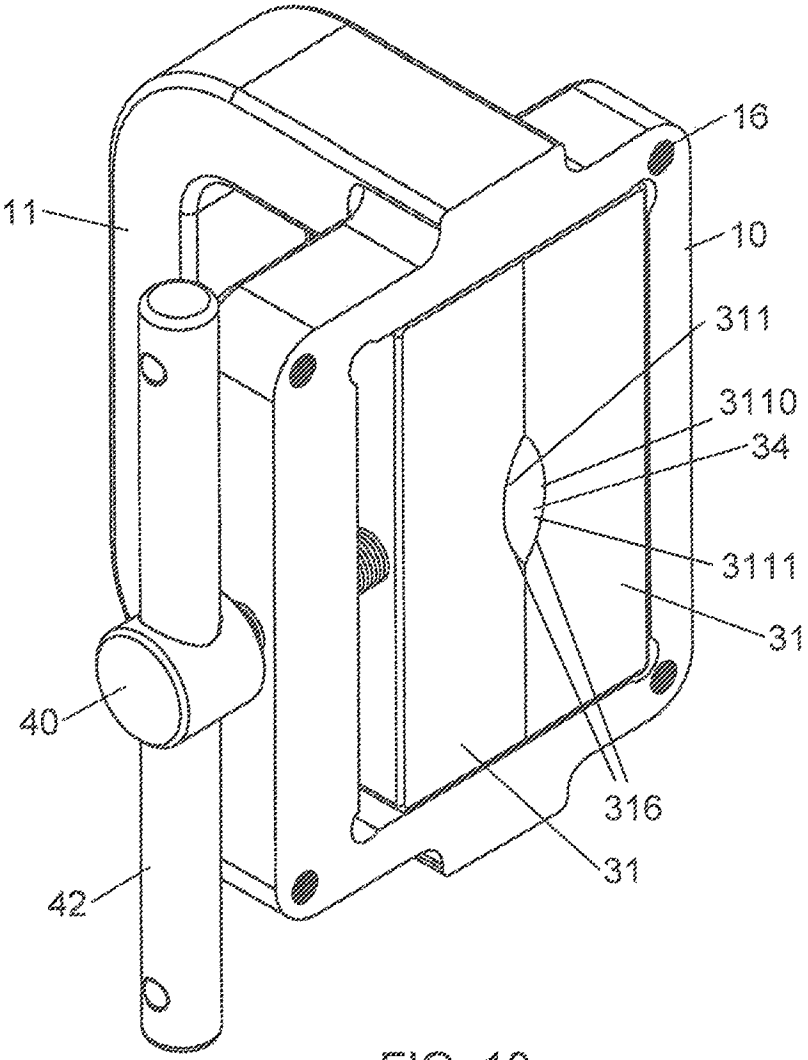
FIG. 13 is a perspective view to show the third embodiment of the pipe enlarging device of the present invention.
Figure 14:
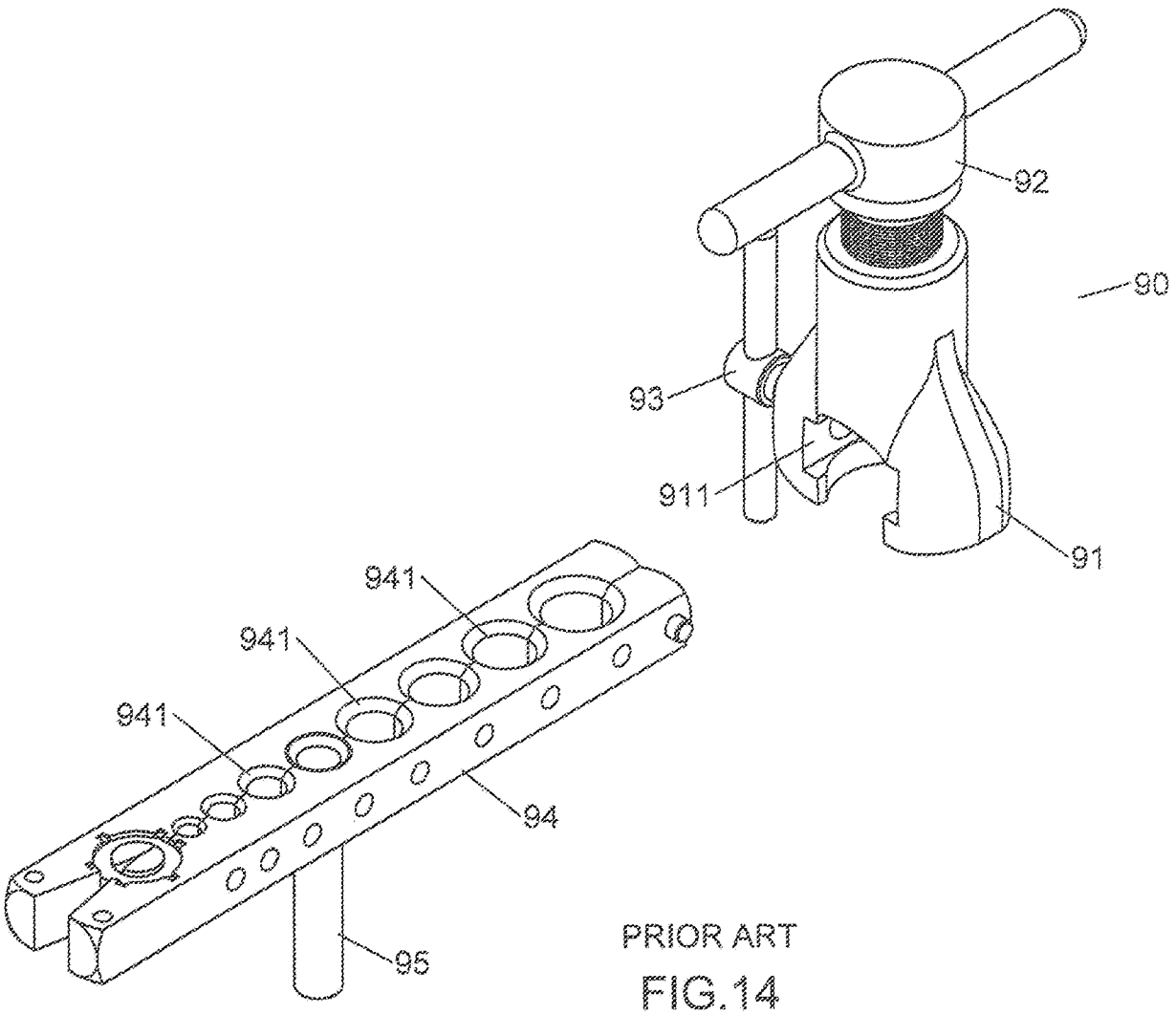
PRIOR ART FIG. 14
FIG. 14 is an exploded view to show a conventional pipe enlarging device.
Figure 15:
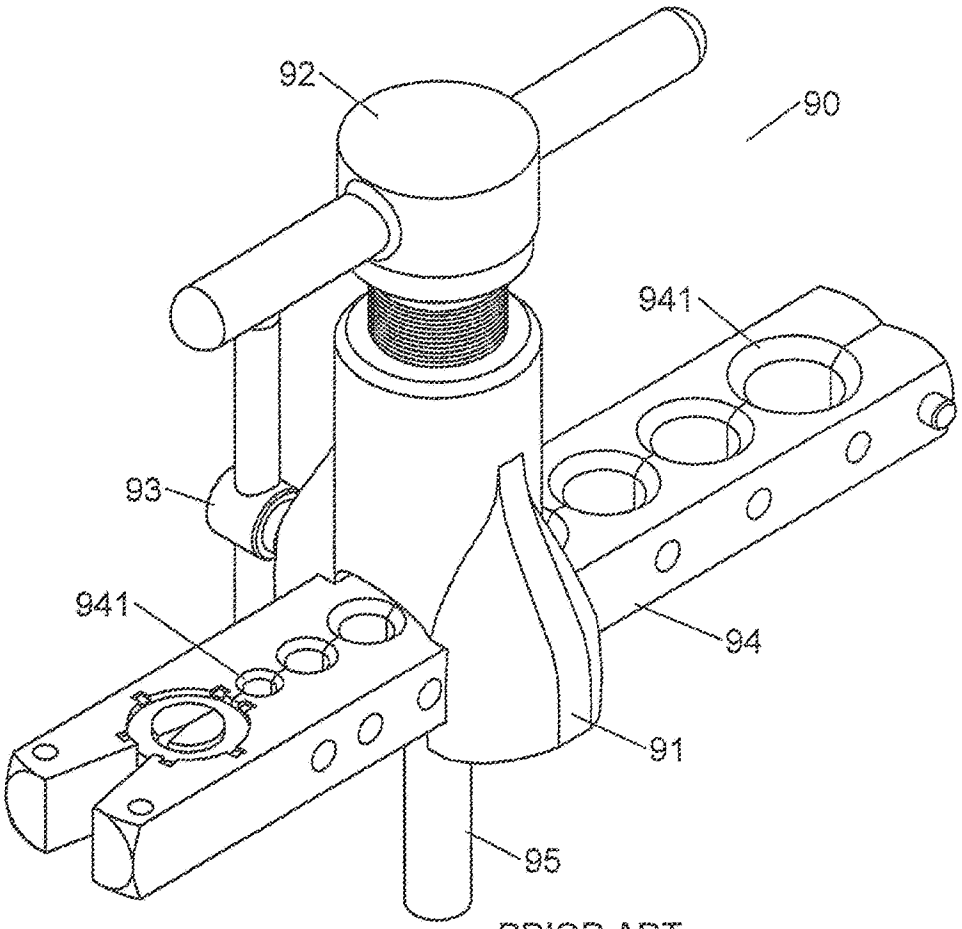
PRIOR ART FIG. 15
FIG. 15 is a perspective view of the conventional pipe enlarging device.

As shown in FIG. 13, in this embodiment, the rear side of the front clamp 31 facing the front side of the rear clamp 310, a reception area 3111 defined between the first and second notches 311, 3110, two first curved faces 316 defined in the first and second notches 311, 3110 respectively. The two first curved faces 316 form the clamping area 34. The front and rear clamps 31, 310 are resiliently movable when the front threaded rod 40 is rotated so as to form an adjustable clamping area 34 between the front and rear clamps 31, 310.

While we have shown and described the embodiment in accordance with the present invention, it should be clear to those skilled in the art that further embodiments may be made without departing from the scope of the present invention.

What is claimed is:

1. A pipe enlarging device comprising:

a base having multiple locking holes defined in an underside thereof, a rectangular room defined in the underside of the base and including an inner bottom, a left wall, a right wall, a front wall and a rear wall, a through hole defined through the inner bottom and a top of the base, a front threaded hole defined through the front wall and communicating with the rectangular room;

a clamping unit located within the rectangular room and including a front clamp and a rear clamp respectively located corresponding to the front wall and the rear wall, the rear clamp contacting the rear wall, the front clamp including a left side and a right side, the left and right sides of the front clamp respectively and horizontally slidable along the left wall and the right wall, the front clamp having at least one first notch defined in a rear side thereof, the rear clamp having at least one second notch defined in a front side thereof, the rear side of the front clamp facing the front side of the rear clamp, a reception area defined between the first and second notches, two first curved faces defined in the first and second notches respectively, a clamping area defined between the two first curved faces; a front threaded rod threadedly extending through the front threaded hole, a first end of the front threaded rod inserted into the room to contacting the front clamp, a front bar connected to a second end of the front threaded rod so as to rotate the front threaded rod; wherein when the front and rear clamps are located at a first position, the two respective first curved faces of the front and rear clamps clamp a first pipe; wherein when the front threaded rod is rotated to push the front clamp toward the rear clamp and to a second position where the first curved faces clamp a second pipe whose outer diameter is smaller than that of the first pipe;

a plate mounted to the underside of the base and closing the room to restrict the clamping unit within the room, the plate including a central hole, the first pipe or the second pipe extending through the central hole of the plate and the through hole of the base, and an operation unit including a bridge connected to the base and extending over the top of the base, a threaded bore defined through the bridge and a top threaded rod threadedly extending through the threaded bore, a cone-shaped member connected to a lower end of the top threaded rod, when the top threaded rod is rotated and the cone-shaped member moves toward the base, the cone-shaped member enters into the first pipe or the second pipe and enlarges an inner diameter of the first pipe or the second pipe, wherein the bridge including a rectangular recess defined in a top thereof; a bore being defined through an inner bottom of the rectangular recess and located corresponding to the through hole; the bore being an elongate bore; the operation unit including a part, a cover and a top bar; the part being movably received in the rectangular recess; the threaded bore being defined through the part; the part and the top threaded rod being co-movable; the cover being mounted to the top of the bridge to restrict the part within the rectangular recess, the top bar being connected to the top threaded rod so as to rotate the top threaded rod; the cover including an elongate hole which is located corresponding to the bore, and the top threaded rod movably extending through the elongate hole and the bore.

2. The pipe enlarging device as claimed in claim 1, wherein the bridge is integral with the base.

3. The pipe enlarging device as claimed in claim 1, wherein two threaded holes are defined in the top of the bridge, the bore is located between the two threaded holes, the cover includes two apertures, two bolts extend through the two apertures and are threadedly connected to the two threaded holes of the bridge to fix the cover to the bridge and to close the rectangular recess.

4. The pipe enlarging device as claimed in claim 1, wherein two protrusions extend from two sides of the base, two engaging holes are respectively defined in the two protrusions, two engaging columns are respectively defined on two distal ends of the bridge, the two engaging columns are inserted into and engage with the corresponding two engaging holes so that the bridge connects to the base.

* * * * *